US009705260B2

(12) United States Patent
Aizawa

(10) Patent No.: US 9,705,260 B2
(45) Date of Patent: Jul. 11, 2017

(54) COLLECTIVE GROUND CONNECTION STRUCTURE FOR CONNECTORS

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Takeshi Aizawa, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electrical Industries, Ltd., Osaka-shi, Osaka (JP)

( * ) Notice: Subject to any disclaimer, the term of this patent is extended or adjusted under 35 U.S.C. 154(b) by 0 days.

(21) Appl. No.: 14/768,833

(22) PCT Filed: May 30, 2013

(86) PCT No.: PCT/JP2013/065011
§ 371 (c)(1),
(2) Date: Aug. 19, 2015

(87) PCT Pub. No.: WO2014/132459
PCT Pub. Date: Sep. 4, 2014

(65) Prior Publication Data

US 2016/0006186 A1 Jan. 7, 2016

(30) Foreign Application Priority Data

Feb. 27, 2013 (JP) ..... 2013-037902

(51) Int. Cl.
*H01R 13/625* (2006.01)
*H01R 13/66* (2006.01)
(Continued)

(52) U.S. Cl.
CPC ..... *H01R 13/6625* (2013.01); *H01R 4/64* (2013.01); *H01R 13/514* (2013.01); *H01R 13/639* (2013.01); *H01R 25/00* (2013.01)

(58) Field of Classification Search
CPC . H01R 13/6625; H01R 13/514; H01R 13/639
(Continued)

(56) References Cited

U.S. PATENT DOCUMENTS 7,683,254 B2 * 3/2010 Shimizu ..... H01R 4/64 174/40 CC
2012/0289087 A1 11/2012 Fujisaki

FOREIGN PATENT DOCUMENTS

JP 2003-178824 6/2003
JP 2009-140690 6/2009
(Continued)

OTHER PUBLICATIONS

International Search Report.

*Primary Examiner* — Tho D Ta
*Assistant Examiner* — Nader Alhawamdeh
(74) *Attorney, Agent, or Firm* — Gerald E. Hespos; Michael J. Porco; Matthew T. Hespos

(57) ABSTRACT

Connectors with internal noise filter (10A, 10B) are provided with a uniting means (17, 18) for uniting the connectors with internal noise filters with each other. A terminal fitting (20) connected to one electrode portion (32A) of a capacitor (30) is provided in a connector housing (11*a*, 11B). A ground connection terminal (40A, 40B) is composed of an electrode connecting portion (42) to be connected to the other electrode portion (32B) of the capacitor (30) and a ground connection portion (41A, 41B) extending outwardly of the connector housing (11A, 11B) from the electrode connecting portion (42) and including a bolt hole (46H) into which a bolt (B) is fittable. When the respective connectors with internal noise filter (10A, 10B) are united by the uniting
(Continued)

means (17, 18), the respective ground connection portions (41A, 41B) are overlapped and the respective bolt holes (46H) are aligned.

6 Claims, 7 Drawing Sheets

(51) Int. Cl.
*H01R 4/64* (2006.01)
*H01R 13/514* (2006.01)
*H01R 13/639* (2006.01)
*H01R 25/00* (2006.01)

(58) Field of Classification Search
USPC ..... 439/345
See application file for complete search history.

(56) References Cited

FOREIGN PATENT DOCUMENTS

| | | | |
|---|---|---|---|
| JP | 2009140690 A | * | 6/2009 |
| JP | 2011-187284 | | 9/2011 |
| JP | 2012-238710 | | 12/2012 |

* cited by examiner

COLLECTIVE GROUND CONNECTION STRUCTURE FOR CONNECTORS

BACKGROUND

1. Field of the Invention

The present invention relates to a structure for collectively connecting connectors with internal noise filter to ground.

2. Description of the Related Art

In interior wiring of an automotive vehicle, a ground connection terminal connected to a negative electrode of a noise filter is extended outwardly of a housing and bolted to fix a connector with internal noise filter (hereinafter, referred to as a connector) mounted on an end part of a ground wire to a ground point such as a vehicle body (see, for example, Japanese Unexamined Patent Publication No. 2011-187284).

A vehicle body has only limited parts usable as ground points. Thus, a plurality of connectors are often concentrated on the same ground point and collectively bolted. However, an operation of successively aligning and fixing a ground connection terminal drawn out from each connector while positioning each connector has been cumbersome.

The present invention was completed based on the above situation and aims to simplify a ground connection operation of a plurality of connectors with internal noise filter.

SUMMARY OF THE INVENTION

A collective ground connection structure for connectors of the present invention is a collective ground connection structure for connectors configured by arranging side by side a plurality of connectors with internal noise filter in each of which a capacitor for noise filtering is accommodated in a connector housing and each of which is fixable by bolting a ground connection terminal mounted in the connector housing to an installation surface connected to ground, characterized in that the respective connectors with internal noise filter include a uniting means for uniting the connectors with internal noise filter with each other, the uniting means is a frame formed with a plurality of accommodation spaces, a terminal fitting connected to one electrode portion of the capacitor is provided in the connector housing of each connector with internal noise filter, the ground connection terminal is composed of an electrode connecting portion to be connected to the other electrode portion of the capacitor and a ground connection portion extending outwardly of the connector housing from the electrode connecting portion and including a bolt hole into which a bolt is fittable, and side surfaces of the connector housings and a partition wall partitioning between the plurality of accommodation spaces formed in the uniting means are arranged in contact with or in proximity to each other and the respective ground connection portions are overlapped and the respective bolt holes are aligned, whereby the ground connection portions are collectively fixable by bolting, when the respective connectors with internal noise filter are united by the uniting means.

According to the present invention, the ground connection portions of the respective connectors with internal noise filter are overlapped, the respective bolt holes are aligned and a position where bolting is performed is automatically determined as the plurality of connectors with internal noise filter are united. Thus, a ground connection operation of the plurality of connectors with internal noise filter becomes easier.

The collective ground connection structure for connectors may be configured so that the uniting means is a frame capable of accommodating each connector with internal noise filter in a retained state in the accommodation space. According to this configuration, the respective connectors with internal noise filter can be united easily via the frame by being accommodated into the accommodation spaces separately provided in the frame.

The collective ground connection structure for connectors may be configured so that the bolt holes of the ground connection portions are oblong holes extending along a uniting direction of the connectors with internal noise filter and a communication hole into which the bolt is insertable is formed when the ground connection terminals are overlapped. According to this configuration, an assembling error in the uniting direction of the connectors with internal noise filter can be absorbed.

The collective ground connection structure for connectors may be configured so that the ground connection portion of the ground connection terminal is provided with a locking portion for stopping rotation of the ground connection terminal by being locked to the installation surface. According to this configuration, the locking portion to be locked to the installation surface is provided on the ground connection portion of the ground connection terminal. Thus, displacement is less likely to occur when the rotation of the connector with internal noise filter is stopped by bolting and a reduction in the grounding performance of the connector can be prevented.

Specific first and second embodiments of a collective ground connection structure for connectors of the invention are described with reference to the drawings.

DETAILED DESCRIPTION

<First Reference Example>

Figure 1:
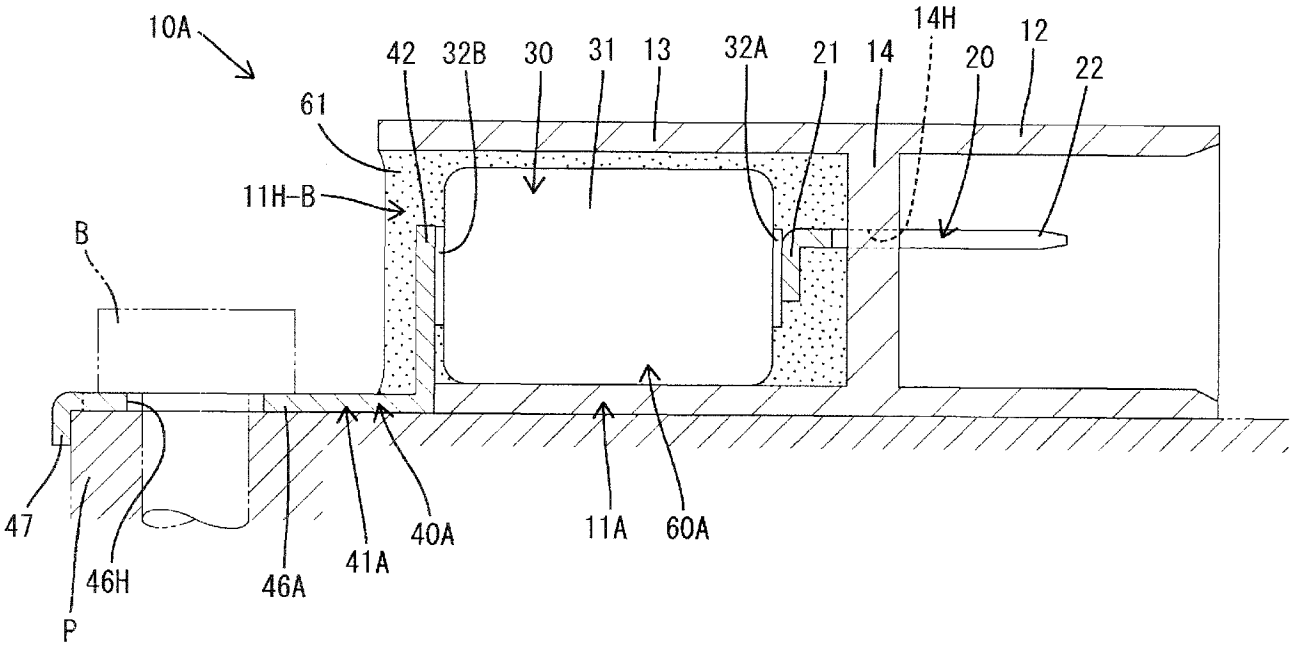
FIG. 1 is a side view in section of a first connector with internal noise filter according to a first reference example.

A first and a second connectors with internal noise filter 10A, 10B (hereinafter, merely referred to as first and second connectors 10A, 10B) of this embodiment include each a busbar terminal (terminal fitting) 20, a noise removal capacitor 30, a first/second connector housing 11A, 11B and a first/second ground connection terminal 40A, 40B. Note that, in the following description, a right side and a left side of FIG. 1 are referred to as a front side and a rear side concerning a front-back direction.

The first/second connector housing 11A, 11B includes an opening 11H (rear opening 11H-B) extending in the front-back direction. A receptacle 12 in the form of a rectangular tube and a capacitor accommodating portion 13 for accommodating the capacitor 30 are provided in each connector housing 11A, 11B while being separated from each other.

Through holes 14H through which terminal portions 22 of the busbar terminal 20 are slightly press-fitted are formed substantially in a central part of a partition wall 14 partitioning between the receptacle 12 and the capacitor accommodating portion 13.

Figure 2:
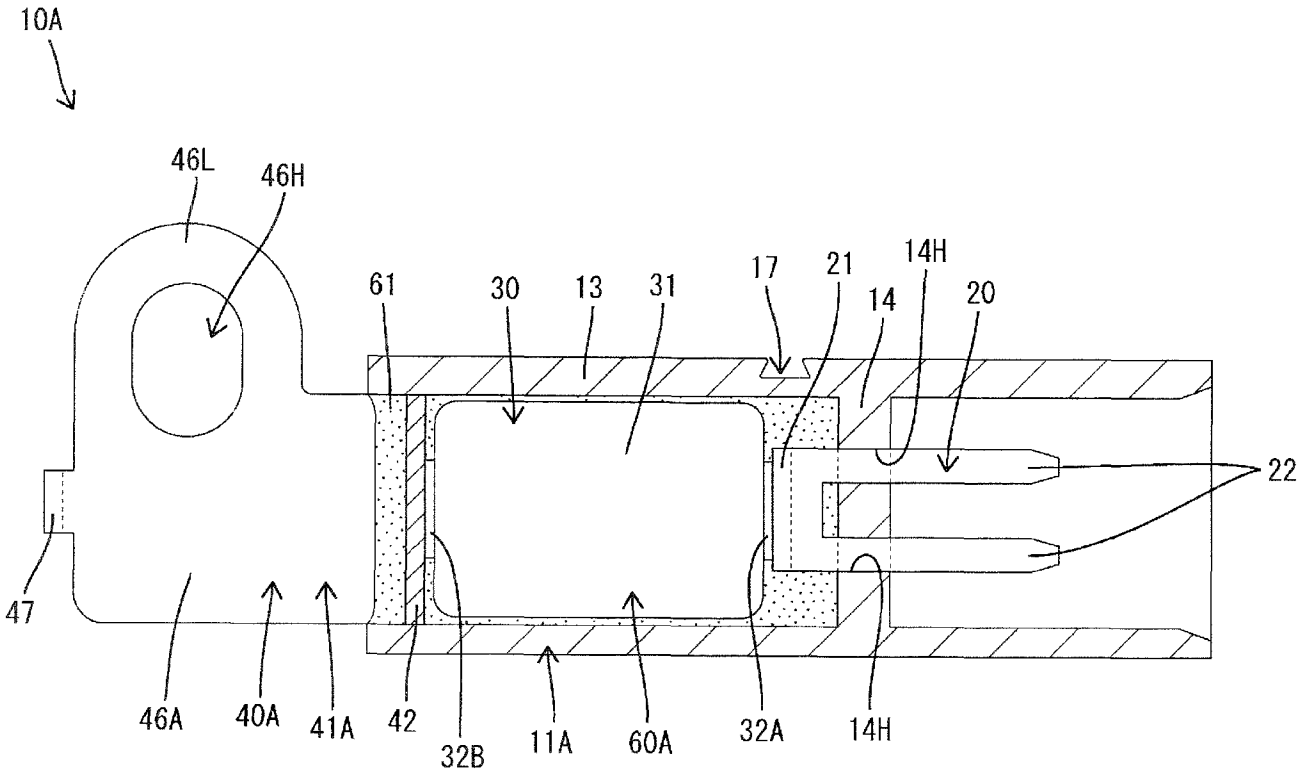
FIG. 2 is a plan view in section of the first connector with internal noise filter.

Further, as shown in FIG. 2, one recess 17 in the form of a dovetail groove is formed in a vertical direction over the entire length on the left side surface of the first connector housing 11A in a width direction. Further, one projection 18 in the form of a dovetail tenon fittable into the recess 17 is formed in the vertical direction over the entire length on the right side surface of the second connector housing 11B in the width direction.

Figure 3:
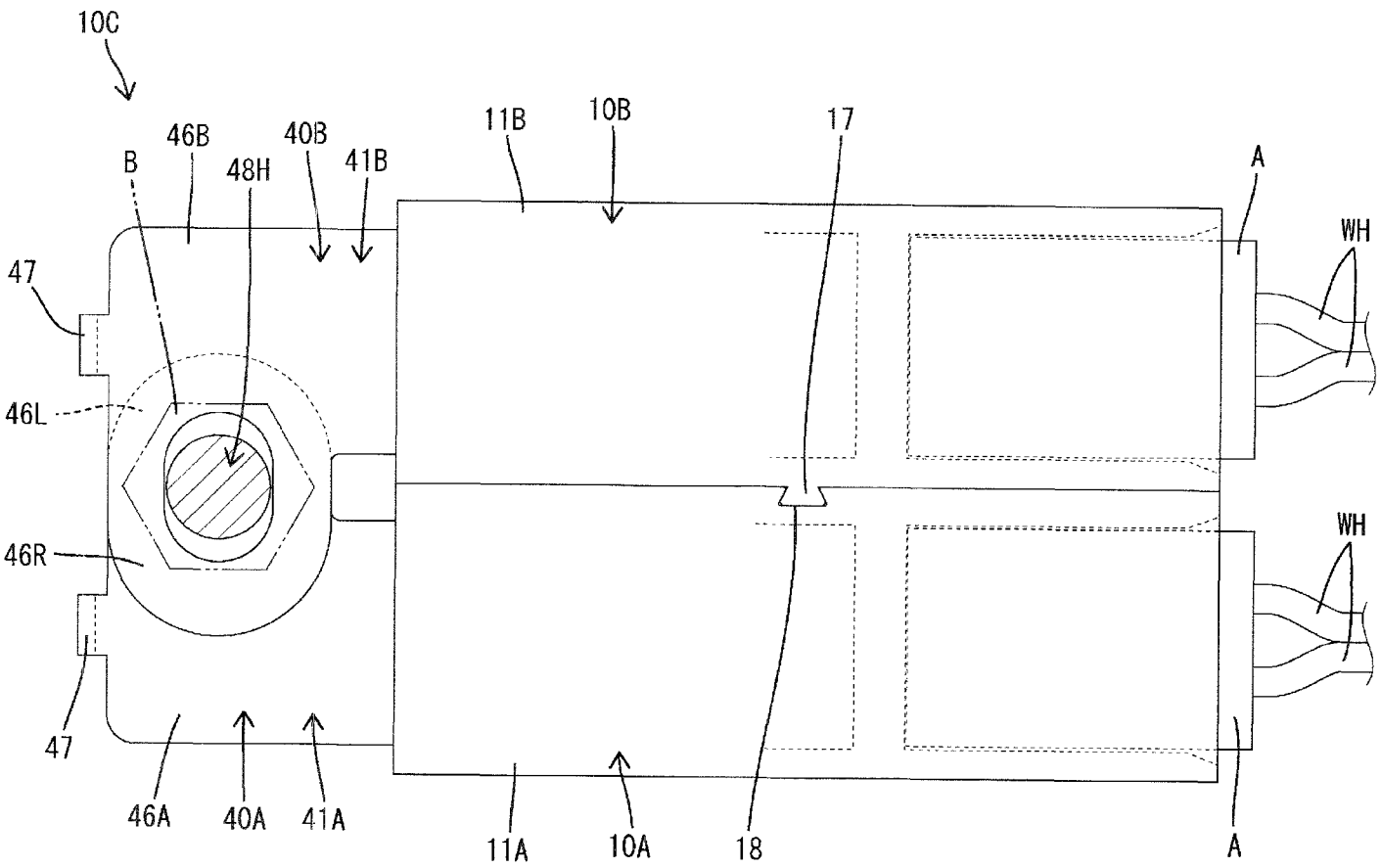
FIG. 3 is a plan view after the first and second connectors with internal noise filter are united.

The busbar terminal 20 (common component constituting each connector 10A, 10B) is formed by punching out an electrically conductive plate member of metal such as copper alloy and applying bending and the like to a punched-out piece. The busbar terminal 20 includes two tab-like terminal portions 22 and an electrode connecting portion 21 formed on rear end parts of the terminal portions 22 by being bent substantially at a right angle. The two terminal portions 22 are electrically connected to female terminal fittings (not shown) of a known form of a block-like mating connector A. Denoted by WH in FIG. 3 are wires connected to the busbar terminals 20 of the respective connector housings 11A, 11B and drawn out from the mating connectors A.

The first/second ground connection terminal 40A, 40B is formed by punching out an electrically conductive plate member of metal such as SUS and applying bending and the like to a punched-out piece similarly to the busbar terminal 20. As shown in FIG. 1, each ground connection terminal 40A, 40B is composed of a first/second ground connection portion 41A, 41B in the form of a flat plate and a ground electrode connecting portion 42 formed by bending the first/second ground connection portion 41A, 41B substantially at a right angle.

As shown in FIG. 1, each of the first and second ground connection portions 41A, 41B is flush with the bottom surface of the connector housing 11A, 11B and formed to protrude backward of the connector housing 11A, 11B. As shown in FIG. 2, the first ground connection portion 41A is composed of a first backward extending portion 46A extending backward and a first coupling portion 46L bent substantially at a right angle to the left of the first backward extending portion 46A. An oblong bolt hole 46H is open substantially on a center axis of the first coupling portion 46L. The second ground connection portion 41B is composed of a second backward extending portion 46B extending backward and a second coupling portion 46R bent substantially at a right angle to the right of the second backward extending portion 46B. An oblong bolt hole 46H is open substantially on a center axis of the second coupling portion 46R as in the first coupling portion 46L. Each connector 10A, 10B is fixed to a vehicle body panel (installation surface) P serving as a ground point by tightening a bolt B into the bolt holes 46H.

Further, as shown in FIG. 1, a locking portion 47 bent substantially at a right angle to extend downward is provided on the rear end edge of the backward extending portion 46A, 46B of each ground connection portion 41A, 41B. The locking portion 47 can position the first/second connector 10 with respect to the vehicle body panel P and stop the rotation of the first/second ground connection terminal 40A, 40B by being locked to an edge part of the vehicle body panel P or the like.

The capacitor 30 (common component constituting each connector 10A, 10B) is a film capacitor and includes a substantially block-like capacitor main body 31 and a pair of electrode portions 32A, 32B provided on opposite front and rear ends of the capacitor main body 31. The front electrode portion 32A is a positive-side electrode 32A and connected to the electrode connecting portion 21 of the busbar terminal 20. The rear electrode portion 32B is a ground-side electrode 32B and connected to the ground electrode connecting portion 42 of each ground connection terminal 40A, 40B.

Next, an example of an assembling procedure of the first and second connectors 10A, 10B is described. First, the ground-side electrodes 32B of the capacitors 30 and the ground electrode connecting portions 42 of the first and second ground connection terminals 40A, 40B are connected by soldering while being held in contact. The positive-side electrodes 32A of the capacitors 30 are also connected to the electrode connecting portions 21 of the busbar terminals 20 by soldering. Assemblies obtained by connecting the first and second ground connection terminals 40A, 40B and the capacitors 30 are referred to as first and second capacitor units 60A, 60B below.

Subsequently, the first and second capacitor units 60A, 60B are respectively horizontally accommodated through the rear openings 11H-B of the first and second connector housings 11A, 11B. At this time, each capacitor unit 60A, 60B is moved forward while the terminal portions 22 of the busbar terminal 20 are slightly press-fitted into the through holes 14H provided on the partition wall 14. The capacitor 30 is arranged on the bottom surface of each connector housing 11A, 11B via an adhesion means. Then, the bottom surface of each connector housing 11A, 11B and the corresponding ground connection portion 41A, 41B become flush with each other and each capacitor unit 60A, 60B is incorporated into the corresponding connector housing 11A, 11B. At this time, as shown in FIG. 2, the first backward extending portion 46A and the first coupling portion 46L of the first ground connection terminal 40A are exposed from the rear end surface of the first connector housing 11A. Further, the second backward extending portion 46B of the second ground connection terminal 40B and the second coupling portion 46R bent in a direction to face the first coupling portion 46L are exposed from the rear end surface of the second connector housing 11B. Finally, as shown in FIG. 1, epoxy resin 61 is filled through the rear openings 11H-B of the first and second connector housings 11A, 11B, thereby closing these openings. In this way, an assembling operation of each connector 10A, 10B is completed.

Next, an operation of uniting the first and second connectors 10A, 10B and placing them on the vehicle body panel P is described. First, the first and second connectors 10A, 10B are arranged in a state displaced in a height direction. Then, the projection 18 provided on the connector housing 11B of the second connector 10A is aligned with and pushed into the recess 17 provided on the connector housing 11A of the first connector 10B. In this way, the both connectors 10A, 10B are united and arranged side by side on the installation surface P. In a united connector 10C, the second coupling portion 46R of the second connector 10B is placed on the first coupling portion 46L of the first connector 10A. The bolt holes 46H provided on the respective coupling portions 46R, 46L and formed to be long in a uniting direction of the connectors 10A, 10B are coupled to form a coupling hole 48A into which the bolt B is insertable. Then, the locking portions 47 provided on the first and second backward extending portions 46A, 46B of the first and second connectors 10 are locked to the edge part of the vehicle body panel P. Finally, the bolt B is inserted into the coupling hole 48H and tightened. In this way, the mounting of the connector 10C onto the vehicle body panel P is completed.

Next, functions and effects of the first reference example are described.

In this reference example, the first coupling portion 46L of the first ground connection portion 41A and the second coupling portion 46R of the second ground connection portion 41B are overlapped as the first and second connectors 10A, 10B are united, and the bolt holes 46H provided on the respective coupling portions 46R, 46L are aligned. Specifically, the both bolt holes 46H are coupled and so positioned that the bolt B can be immediately insertable by uniting the both connectors 10A, 10B. Thus, the both connectors 10A, 10B can be easily connected to ground while being kept united.

Further, since the both connectors 10A, 10B are united by a dovetail engagement structure formed on the respective connectors 10A, 10B, the structure is simple and the assembling is easy.

Further, the bolt hole 46H provided on each ground connection portion 41A, 41B is in the form of an oblong hole extending along the uniting direction of the connectors 10A, 10B. When the both ground connection terminals 41A, 41B are overlapped by uniting the both connectors 10A, 10B, the aligned coupling hole 48H into which the bolt B is insertable is formed. Thus, an assembling error in the uniting direction of the connectors 10A, 10B can be absorbed.

Further, the locking portions 47 to be locked to the edge part of the vehicle body panel P are provided on the rear end edges of the backward extending portions 46A, 46B of the respective ground connection terminals 40A, 40B of the both connectors 10A, 10B. Thus, when the both connectors 10A, 10B are bolted to stop rotation, displacement is less likely to occur and an associated reduction in the grounding performance of the connectors 10A, 10B can be prevented.

<Second Reference Example>

Figure 4:
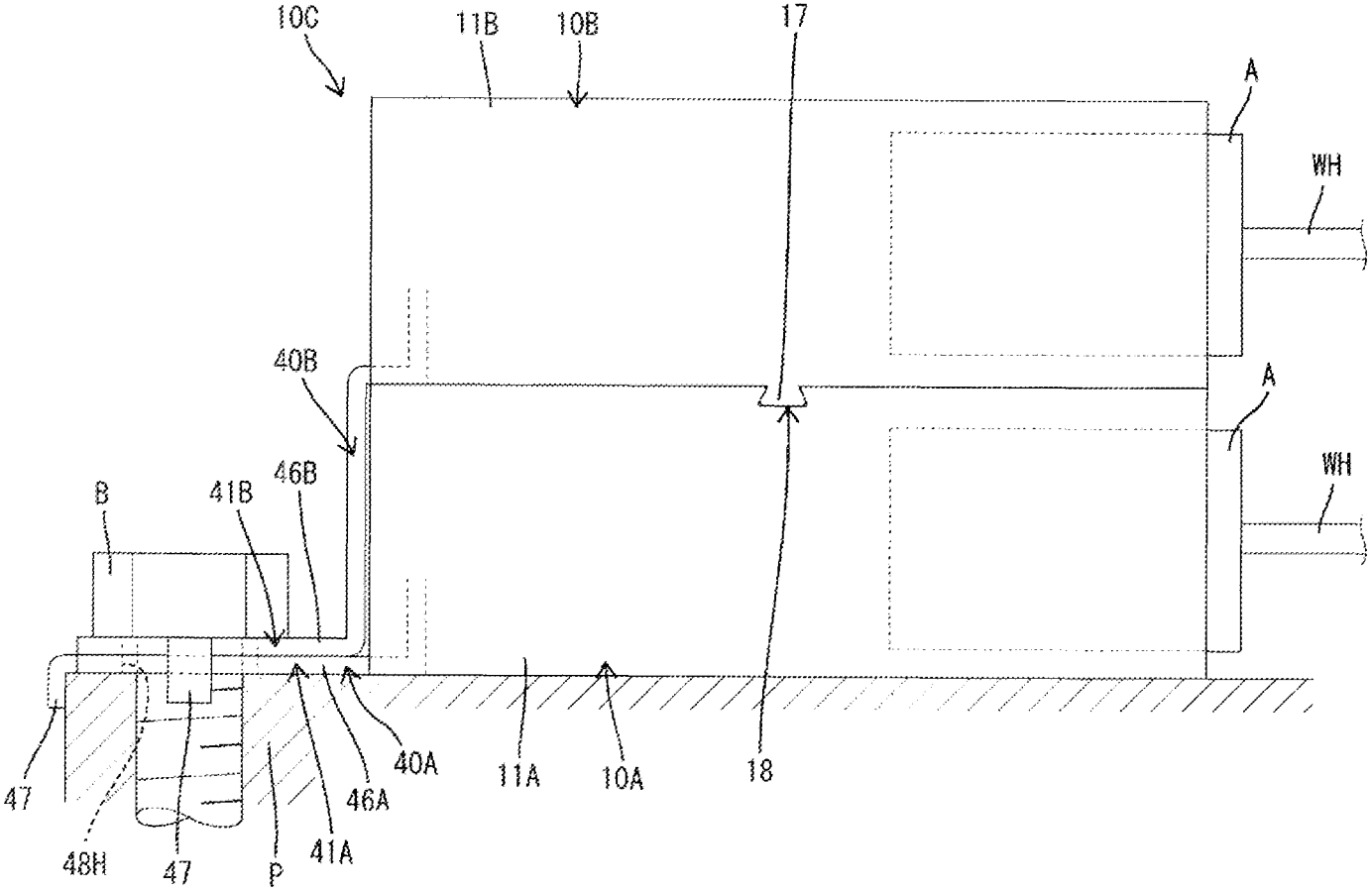
FIG. 4 is a side view after first and second connectors with internal noise filter according to a second reference example are united.

FIG. 4 is a side view in section of a first and a second connectors with internal noise filter 10A, 10B (hereinafter, merely referred to as first and second connectors 10A, 10B) according to a second reference example. Note that, in the following description, a right side and a left side of FIG. 4 are referred to as a front side and a rear side concerning a front-back direction.

Unlike the first reference example in which the connectors 10A, 10B are arranged side by side in the horizontal direction, the first and second connectors 10A, 10B are arranged side by side in a height direction in the second reference example. The formation positions of a recess 17 and a projection 18 on the connector housings 11A, 11B corresponding to the first and second connectors 10A, 10B and the shapes of backward extending portions 46A, 46B of first and second ground connection terminals 40A, 40B are different from those in the first embodiment.

As shown in FIG. 4, one recess 17 in the form of a dovetail groove is formed in a width direction (direction intersecting with a connecting direction to a mating connector A) on the upper surface of the first connector housing 11A. Further, one projection 18 in the form of a dovetail tenon is provided in the width direction on the lower surface of the second connector housing 11B.

A first/second ground connection portion 41A, 41B of the first/second ground connection terminal 40A, 40B is composed of a first/second backward extending portion 46A, 46B extending backward from the bottom surface of the first/second connector housing 11A, 11B and a locking portion 47 formed to extend downward from the backward extending portion 46A, 46B (unlike the first reference example, the first and second coupling portions 46L, 46R are not formed). A right circular bolt hole 46H into which a bolt B is fittable is open substantially in a center of a rear end part of the first backward extending portion 46A. The second backward extending portion 46B is longer than the first backward extending portion 46A. Further, as shown in FIG. 4, the second backward extending portion 46B is bent twice into a crank shape to extend downward over the entire length thereof. A bolt hole 46H is open on a rear end part of the second backward extending portion 46B as on the first backward extending portion 46A. The locking portion 47 is positioned on the rear end edge of the first backward extending portion 46A as in the first reference example. On the other hand, the locking portion 47 is provided on a right end edge in the width direction in the rear end part of the second backward extending portion 46B. The other configuration is common to the first reference example and, hence, not described.

The both connectors 10A, 10B are united by engaging the recess 17 and the projection 18 provided on the both connector housings 11A, 11B as in the first reference example. In the United States, the second backward extending portion 46B is placed on the first backward extending portion 46A. Then, the locking portion 47 provided on the right end edge in the width direction of the backward extending portion 46B is locked to the right end edge of the first backward extending portion 46A as shown in FIG. 4. Associated with this, the bolt holes 46H provided on the respective backward extending portions 46A, 46B are aligned and a position where bolting is possible is automatically determined as shown in FIG. 4.

As described above, according to the second reference example, the bolt holes 46H of the respective ground connection terminals 40A, 40B of the both connectors 10A, 10B can be aligned by arranging the first and second connectors 10A, 10B side by side in the height direction and uniting them. In this way, the bolting position is automatically determined and the both connectors 10A, 10B can be easily connected to ground.

<First Embodiment>

Figure 5:
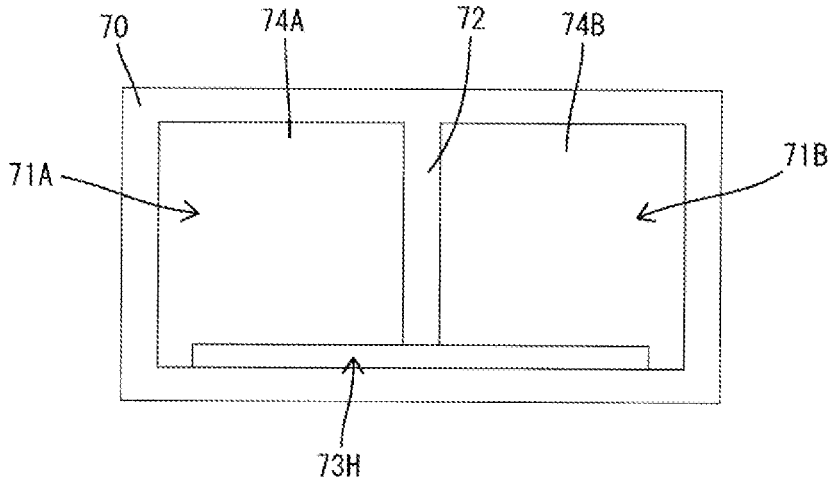
FIG. 5 is a front view of a frame according to a first embodiment.

FIG. 5 is a front view of a frame 70 capable of accommodating a first and a second connectors with internal noise filter 10A, 10B (hereinafter, merely referred to as first and second connectors 10A, 10B) according to a first embodiment inside. Note that, in the following description, a right side and a left side of FIG. 6 are referred to as a front side and a rear side concerning a front-back direction.

In the first embodiment, the first and second connectors 10A, 10B are united by being accommodated into the separately provided frame 70 instead of by the engagement of the recess and the projection 17, 18 provided on the respective connector housings 11A, 11B unlike the aforementioned first reference example. The configurations of the respective connectors 10A, 10B are common to the first embodiment except that the recess 17 and the projection 18 are not provided and a ground connection portion 41A, 41B of each ground connection terminal 40A, 40B is bent into a crank shape (hereinafter, referred to as a cranked portion C). Thus, detailed description is not given.

Figure 6:
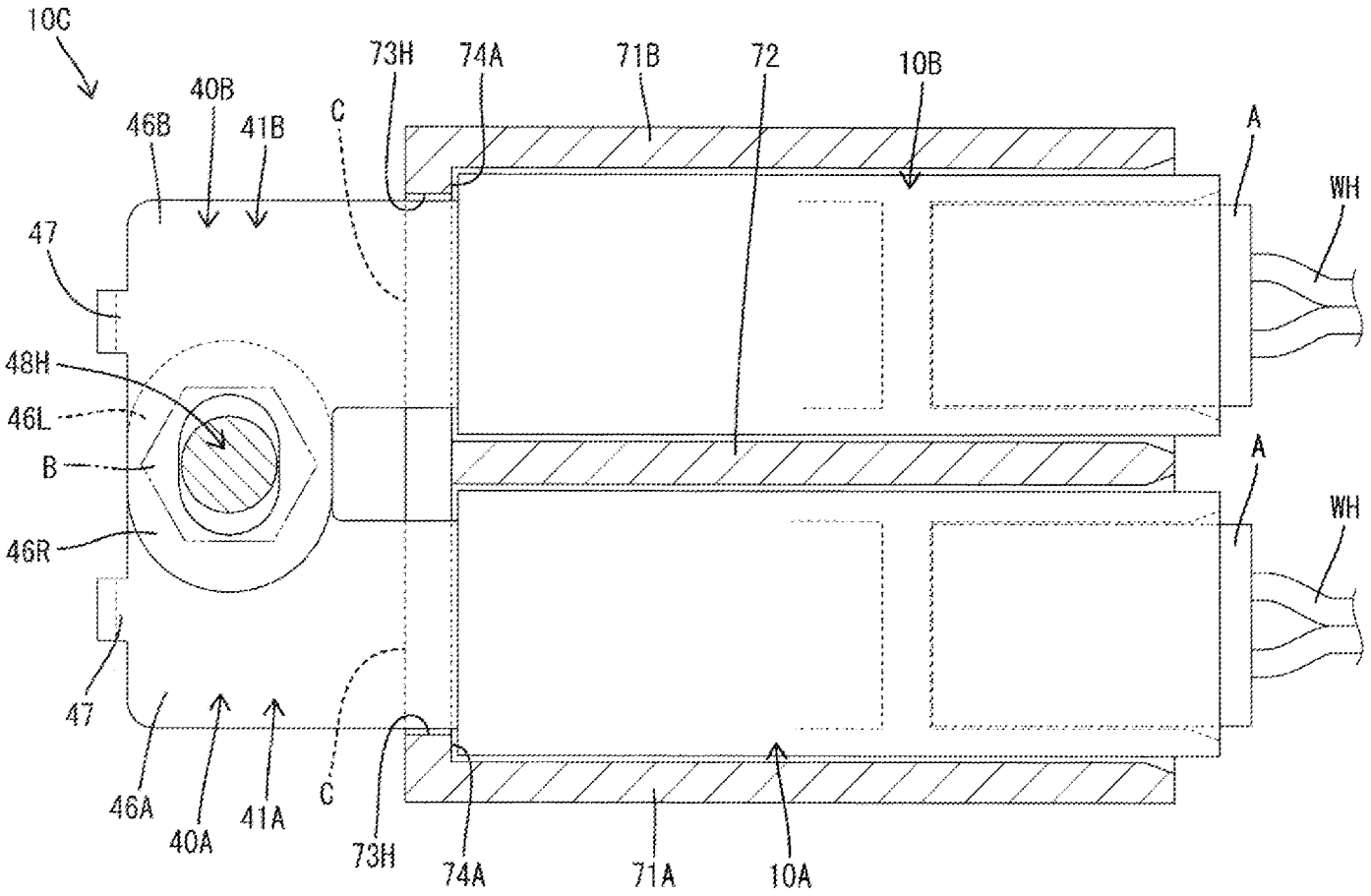
FIG. 6 is a plan view in section after first and second connectors with internal noise filter according to the first embodiment are united.

The frame 70 is made of synthetic resin and formed into a substantially box shape open forward as shown in FIG. 6. Inside the frame 70, a first accommodation chamber (accommodation space) 71A into which the first connector 10A is substantially tightly accommodated from front and a second accommodation chamber (accommodation space) 71B into which the second connector 10B is substantially tightly accommodated from front are arranged side by side in a width direction and separated by a partition wall 72. Each connector 10A, 10B can be stopped so as not to move any further backward by a rear wall 74A, 74B of each accommodation chamber 71A, 71B. Further, a ground plate insertion hole 73H is open in the front-back direction in a bottom part of the frame 70 so that a first coupling portion 46L of the first connector 10A and a second coupling portion 46R of the second connector 10B can pass through the interior of the frame 70 when the respective connectors 10A, 10B are accommodated into the corresponding accommodation chambers 71A, 71B. As shown in FIG. 5, the respective accommodation chambers 71A, 71B communicate via the ground plate insertion hole 73H.

Next, one example of a uniting operation and a ground connection operation of the both connectors 10A, 10B is described. First, the first and second connectors 10A, 10B are so accommodated into the first and second accommodation chambers 71A, 71B of the frame 70 that the first ground connection terminals 40A, 40B face backward. The respective connectors 10A, 10B are inserted until rear end parts thereof come into contact with the rear walls 74A, 74B of the corresponding accommodation chambers 71A, 71B. Then, the first and second ground connection portions 41A, 41B respectively project through the ground plate insertion hole 73H provided on lower parts of the rear walls 74A, 74B. The cranked portions C of the respective backward extending portions 46A, 46B are locked to the rear end edge of the bottom surface of the frame 70, whereby the both connectors 10A, 10B are united in a state positioned in the frame 70 (the united both connectors 10A, 10B are referred to as a connector 100 below). Further, when the uniting is completed, the second coupling portion 46R of the second ground connection portion 41B is placed on the first coupling portion 46L of the first ground connection portion 41A as in the first reference example. Then, bolt holes 46H in the form of oblong holes provided on the coupling portions 46L, 46R are coupled to form a coupling hole 48H into which a bolt is insertable. Finally, if the connector 100 is fixed by being bolted to a vehicle body panel P as in the first reference example, the connector 100 can be easily connected to ground.

According to this first embodiment, the both connectors 10A, 10B can be easily united by separately providing the frame 70 capable of accommodating the first and second connectors 10A, 10B inside. Further, the recess and the projection 17, 18 as used in the first and second reference examples need not be provided on the connector housings 11A, 11B. Thus, the connector housings 11A, 11B can be made into common components and versatility is excellent.

<Second Embodiment>

Figure 7:
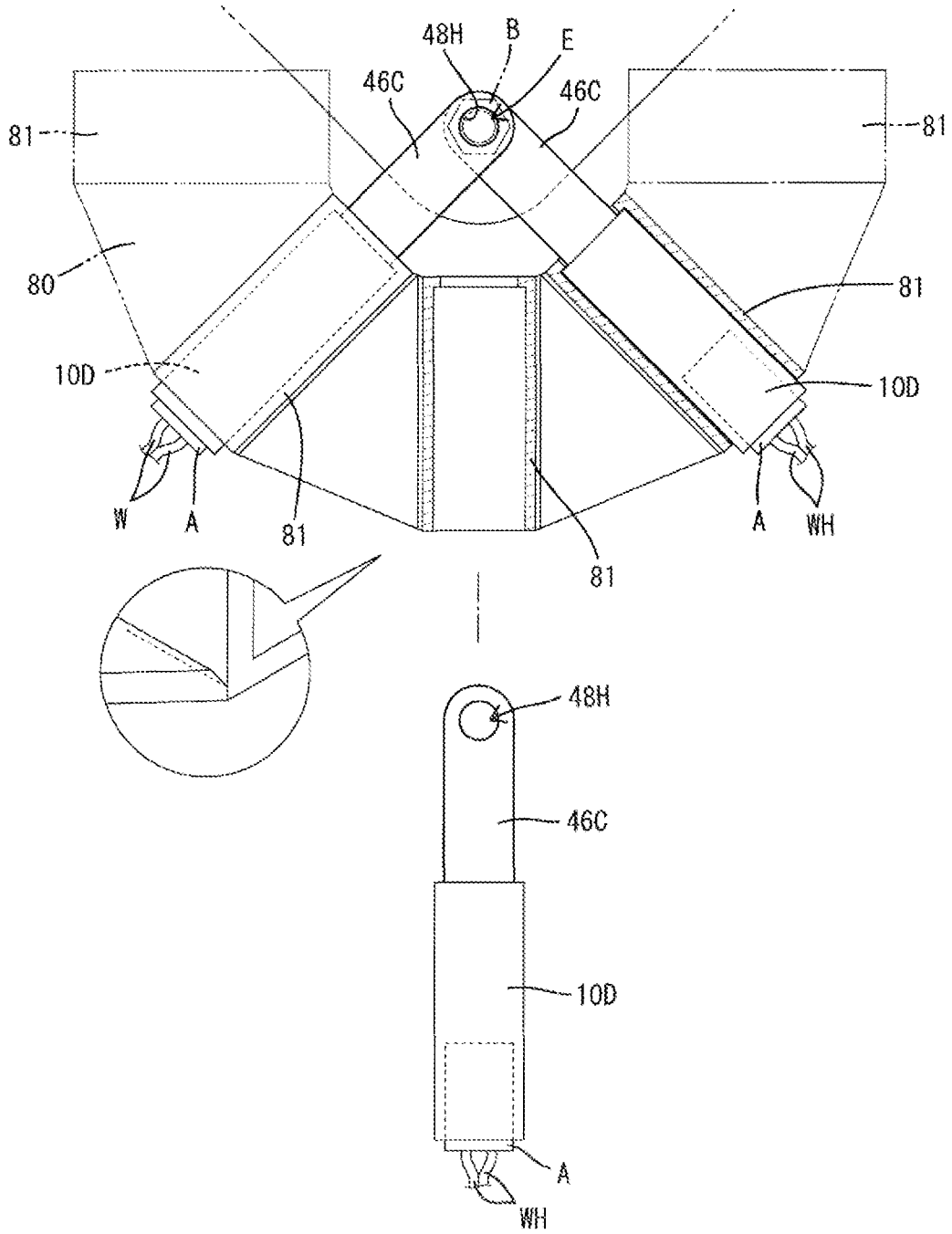
FIG. 7 is a schematic diagram showing a ground connection structure for a plurality of connectors with internal noise filter according to a second embodiment.

FIG. 7 schematically shows a structure for collectively connecting three or more connectors 10D to the same ground point E. Although not described in detail, an arcuate frame 80 centered on a position of bolting (ground point E) is provided. A plurality of connector accommodation chambers 81 each capable of accommodating the connector 10D are formed at equal angular intervals at radial positions centered on the ground point E on the outer upper surface of the frame 80. The connector 10D is so accommodated into the individual connector accommodation chamber 81 that a backward extending portion 46C thereof faces the ground point E. Then, the backward extending portions 46C of the plurality of connectors 10D are overlapped as in the first embodiment and bolt holes 46H provided on the backward extending portions 46C are coupled. By adopting the configuration as in the first embodiment, the connectors 10D can be united and easily connected to the same ground point E by being respectively accommodated into the plurality of connector accommodation chambers 81 provided in the arcuate frame 80.

As described above, according to the present invention, the respective ground connection portions 41A, 41B of the respective connectors with internal noise filter 10A, 10B are overlapped and the respective bolt holes 46H are aligned as the plurality of connectors with internal noise filter 10A, 10B are united. Thus, the position where bolting is performed is automatically determined, wherefore the ground connection operation of the connectors with internal noise filter 10A, 10B becomes easily.

<Other Embodiments>

The present invention is not limited to the above described and illustrated embodiments. For example, the following embodiments are also included in the technical scope of the present invention.

Although one locking portion is provided on the rear end part of the ground connection portion in the above embodiments, there is no limitation to this and the formation position(s) and the number of the locking portion(s) are not limited.

Although the film capacitor is used as the capacitor in the above embodiments, there is no limitation to this and an electrolytic capacitor or a ceramic capacitor may be used.

Although one capacitor is incorporated in each connector in the above embodiments, there is no limitation to this and two or more capacitors may be incorporated.

Although the capacitors to be mounted into the respective connectors are the same in the above embodiments, there is no limitation to this and the types, capacities and the like of the capacitors may be different.

Although the busbar terminals are used as the terminal fittings in the above embodiments, female terminal fittings or male terminal fittings other than busbar terminals may be used.

Although the terminal fitting has two terminal portions in the above embodiments, there is no limitation to this and the number of the terminal portions is not limited.

Although the terminal fitting and the electrode portion of the capacitor are connected by soldering in the above embodiments, there is no limitation to this and they may be connected by resistance welding or laser welding.

Although the recess in the form of a dovetail groove and the projection in the form of a dovetail tenon are engaged as a uniting means in the above reference examples, there is no limitation to this and differently shaped recess and projection may be adopted. Further, a uniting means separate from the connector housings may be used.

Although two connectors are united by the uniting means composed of the recess and the projection in the above reference examples, three or more connectors may be united by a similar uniting means.

LIST OF REFERENCE SIGNS

10A, 10B, 10C, 10D . . . connector with internal noise filter
11A, 11B . . . connector housing
17 . . . recess (uniting means)
18 . . . projection (uniting means)
20 . . . busbar terminal (terminal fitting)
30 . . . capacitor
32A, 32B . . . electrode portion
40A, 40B . . . ground connection terminal
41A, 41B . . . ground connection portion

42 . . . ground electrode connecting portion (electrode connecting portion)
46H . . . bolt hole, oblong hole
47 . . . locking portion
48H . . . coupling hole
70, 80 . . . frame (uniting means)
71A, 71B . . . accommodation chamber (accommodation space)
81 . . . connector accommodation chamber (accommodation space)
B . . . bolt
P . . . vehicle body panel (installation surface)

The invention claimed is:

1. A collective ground connection structure, comprising:

a uniting frame having opposite front and rear ends, opposed top and bottom walls extending between the ends, opposed first and second side walls extending between the top and bottom walls, a partition wall extending from the top wall towards the bottom wall at a position between the side walls to define first and second forwardly open accommodating chambers on opposite sides of the partition wall, a rear wall at the rear end of the uniting frame and extending between the sidewalls, and a ground plate insertion hole being formed between the rear wall and the bottom wall;

first and second housings accommodated respectively in the first and second accommodating chambers, each of the first and second housings having a front end with a forwardly open receptacle, a rear end with a rearwardly open accommodating space and a transverse partition wall between the receptacle and the accommodating space;

first and second capacitors accommodated respectively in the accommodating spaces of the first and second housings, each of the first and second capacitors having a positive electrode and a ground electrode;

first and second terminal fittings connected to the respective positive electrodes of the first and second capacitors and projecting through the transverse partition walls and into the respective first and second receptacles; and first and second ground connection terminals connected to the respective ground electrodes and projecting beyond the rear ends of the respective first and second housings and through the ground plate insertion hole of the uniting frame, the first and second ground connection terminals being formed respectively with first and second couplings rearward of the uniting frame and overlapped with one another, the first and second couplings being formed respectively with first and second bolt holes that align with one another for receiving a bolt to collectively fix the first and second ground connection terminals to a ground.

2. The collective ground connection structure of claim 1, wherein the uniting frame is capable of accommodating each of the first and second connectors in a retained state in the corresponding accommodation space.

3. The collective ground connection structure of claim 1, wherein the bolt holes of the first and second coupling portions are oblong holes extending along a uniting direction of the first and second connectors and a communication hole into which the bolt is insertable is formed when the ground connection terminals are overlapped.

4. The collective ground connection structure of claim 3, wherein the ground connection portion of the ground connection terminal is provided with a locking portion for stopping the rotation of the ground connection terminal by being locked to the installation surface.

5. The collective ground connection structure of claim 1, wherein the ground connection portion of the ground connection terminal is provided with a locking portion for stopping the rotation of the ground connection terminal by being locked to the installation surface.

6. The collective ground connection structure of claim 1, wherein the partition wall of the uniting frame is spaced from the bottom wall at all locations from the front end to the rear end of the uniting frame.

* * * * *